US009765585B2

(12) United States Patent
Wesemeier et al.

(10) Patent No.: US 9,765,585 B2
(45) Date of Patent: Sep. 19, 2017

(54) CORING TOOLS AND METHODS FOR MAKING CORING TOOLS AND PROCURING CORE SAMPLES

(71) Applicant: Baker Hughes Incorporated, Houston, TX (US)

(72) Inventors: Christoph Wesemeier, Hannover (DE); Thomas Uhlenberg, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 323 days.

(21) Appl. No.: 14/330,628

(22) Filed: Jul. 14, 2014

(65) Prior Publication Data

US 2015/0021096 A1 Jan. 22, 2015

Related U.S. Application Data

(60) Provisional application No. 61/847,911, filed on Jul. 18, 2013.

(51) Int. Cl.

| | |
|---|---|
| ***E21B 10/02*** | (2006.01) |
| ***E21B 27/00*** | (2006.01) |
| ***E21B 49/02*** | (2006.01) |
| ***E21B 25/08*** | (2006.01) |

(52) U.S. Cl.

CPC ..... *E21B 25/08* (2013.01)

(58) Field of Classification Search

CPC ..... E21B 25/08; E21B 25/06; E21B 25/00; G01N 25/14

See application file for complete search history.

(56) References Cited

U.S. PATENT DOCUMENTS

| | | | | |
|---|---|---|---|---|
| 1,815,391 A * | 7/1931 | Zublin | E21B 25/00 175/239 |
| 1,853,581 A * | 4/1932 | Schmissrauter | E21B 25/00 175/245 |
| 3,454,117 A * | 7/1969 | Eckel | E21B 25/08 175/226 |
| 4,142,594 A * | 3/1979 | Thompson | E21B 25/08 175/233 |

(Continued)

OTHER PUBLICATIONS

International Search Report for International Application No. PCT/US2014/047165 dated Nov. 12, 2014, 4 pages.

(Continued)

*Primary Examiner* — Daniel P Stephenson
(74) *Attorney, Agent, or Firm* — TraskBritt

(57) ABSTRACT

Methods of procuring a core sample may involve engaging an earth formation with a cutting structure of a coring bit. A core sample may be received within a receptacle connected to the coring bit, the receptacle being lined with a sponge material. A space of about 1 mm or less may be maintained between the core sample and the sponge material. Coring tools may include a coring bit comprising an inner gage and an outer gage and a sponge material positioned to at least partially surround a core sample cut by the coring bit. A radial distance between an inner surface of the sponge material and the inner gage of the coring bit may be about 1 mm or less. A distance between a center of curvature of the inner gage and a center of curvature of the outer gage may be about 0.3 mm or less.

25 Claims, 4 Drawing Sheets

(56) References Cited

U.S. PATENT DOCUMENTS 4,479,557 A * 10/1984 Park ..... E21B 25/08 175/249
4,502,553 A * 3/1985 Park ..... E21B 25/06 166/228
4,566,545 A * 1/1986 Story ..... E21B 25/12 175/226
4,598,777 A * 7/1986 Park ..... E21B 25/08 175/226
4,716,974 A * 1/1988 Radford ..... E21B 25/08 175/59
4,787,983 A * 11/1988 DiFoggio ..... E21B 25/06 210/656
5,251,710 A * 10/1993 Laporte ..... E21B 17/1078 175/325.2
6,425,447 B1 * 7/2002 Bartette ..... E21B 25/06 175/58
6,719,070 B1 4/2004 Puymbroeck et al.
7,234,547 B2 * 6/2007 Puymbroeck ..... E21B 25/06 175/250
9,217,306 B2 * 12/2015 Wilson ..... E21B 25/06
2002/0139583 A1 10/2002 Masui et al.
2006/0169494 A1 8/2006 Puymbroeck et al.
2009/0139768 A1 6/2009 Castillo
2011/0253452 A1 10/2011 Beuershausen et al.
2013/0081878 A1 4/2013 Wilson
2013/0152356 A1 6/2013 Ownby et al.
2015/0021096 A1 * 1/2015 Wesemeier ..... E21B 25/08 175/58
2016/0010401 A1 * 1/2016 Fulda ..... E21B 10/02 175/58

OTHER PUBLICATIONS

International Written Opinion for International Application No. PCT/US2014/047165 dated Nov. 12, 2014, 13 pages.
European extended search report for European Application No. 14826633.1 dated Feb. 16, 2017, 7 pages.

* cited by examiner

CORING TOOLS AND METHODS FOR MAKING CORING TOOLS AND PROCURING CORE SAMPLES

CROSS-REFERENCE TO RELATED APPLICATIONS

This application claims the benefit of U.S. Provisional Patent Application Ser. No. 61/847,911, filed Jul. 18, 2013, and titled "CORING TOOLS AND METHODS FOR MAKING CORING TOOLS AND PROCURING CORE SAMPLES." The subject matter of this application is also related to the subject matter disclosed in U.S. patent application Ser. No. 15/430,673, filed Feb. 13, 2017, and titled "CORING TOOLS EXHIBITING REDUCED ROTATIONAL ECCENTRICITY AND RELATED METHODS." disclosure of each of which is incorporated herein in its entirety by this reference.

FIELD

The disclosure relates generally to coring tools for obtaining core samples of earth formations. More specifically, disclosed embodiments relate to coring tools that may better capture escaping material from a core sample, improving the accuracy with which the core sample represents actual earth formation characteristics.

BACKGROUND

When seeking information regarding the characteristics of an earth formation, such as, for example, the degree to which it is saturated in hydrocarbons, a core sample may be obtained from the earth formation. The core sample may then be analyzed to determine the characteristics of the earth formation. Core samples may be obtained using coring tools. Coring tools conventionally include a coring bit, which may include an inner bore and a cutting structure surrounding the inner bore. As the coring tool is driven into an earth formation, typically at the bottom of a previously formed borehole, the coring bit may remove earth material from around a core sample, which is received into the inner bore. A receptacle may be connected to the coring bit and may extend longitudinally above the coring bit. The core sample may be received into the receptacle and may be retained in the receptacle by a core catcher to keep the core sample within the receptacle as the core bit is withdrawn from the borehole. Liquids and gases from within the core sample may escape from the core sample as the core sample travels up and out of the borehole. A sponge material formed from an absorbent material, which may be particularly adapted to absorb materials of interest, such as, hydrocarbons, may line the receptacle and may capture at least some of the liquids and gases as they escape from the core sample. The materials of interest may be recovered from the sponge material at the surface and may be analyzed along with the core sample and any liquids and gases still contained therein to determine the characteristics of the earth formation.

BRIEF SUMMARY

In some embodiments, coring tools may include a coring bit comprising an inner gage, an outer gage, and a sponge material positioned to at least partially surround a core sample cut by the coring bit. A radial distance between an inner surface of the sponge material and the inner gage of the coring bit may be about 1 mm or less along at least 75% of a longitudinal length of the sponge material. A distance between a center of curvature of the inner gage and a center of curvature of the outer gage may be about 0.3 mm or less.

In other embodiments, methods of making coring tools may involve rotating a body of a coring bit about an axis of rotation while forming an inner gage in the body. The body may be rotated about the same axis of rotation while forming an outer gage on the body.

In yet other embodiments, coring tools may include a coring bit comprising a cutting structure surrounding an inner bore. The cutting structure may comprise an outer gage at a radially outermost position on the coring bit and an inner gage at a periphery of the inner bore. The inner gage may be configured to cut a core sample to be received into the inner bore. A receptacle may be connected to the coring bit, the receptacle comprising an inner surface defining a bore configured to receive a core sample within the bore. A sponge material may be attached to the inner surface of the receptacle, the sponge material being configured to absorb a fluid expected to be found within the core sample. A difference between a diameter defined by an inner surface of the sponge material and a diameter of the inner gage may be about 1 mm or less along at least 75% of a longitudinal length of the sponge material.

In other embodiments, methods of making coring tools may involve forming an inner gage and an outer gage on a coring bit comprising a cutting structure surrounding an inner bore. The outer gage may be formed at a radially outermost position on the coring bit and the inner gage being may be formed at a periphery of the inner bore. The inner gage may be configured to cut a core sample to be received into the inner bore. A receptacle may be connected to the coring bit, the receptacle comprising an inner surface defining a bore configured to receive a core sample within the bore. A sponge material may be attached to the inner surface of the receptacle, the sponge material being configured to absorb a fluid expected to be found within the core sample. Forming the inner gage may comprise forming a diameter of the inner gage to be smaller than a diameter defined by an inner surface of the sponge material by about 1 mm or less along at least 75% of a longitudinal length of the sponge material.

In still other embodiments, methods of procuring a core sample using a coring tool may involve engaging an earth formation with a cutting structure of a coring bit. A core sample may be received within a bore of a receptacle connected to the coring bit, the receptacle being lined with a sponge material. A space of about 1 mm or less may be maintained between the core sample and the sponge material.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings, in which:

DETAILED DESCRIPTION

The illustrations presented herein are not meant to be actual views of any particular coring tool or component thereof, but are merely idealized representations employed to describe illustrative embodiments. Thus, the drawings are not necessarily to scale.

Disclosed embodiments relate generally to coring tools that may better capture escaping material from a core sample, improving the accuracy with which the core sample represents actual earth formation characteristics. More specifically, disclosed are embodiments of apparatuses that may reduce the distance between a core sample and a sponge material within a coring tool, while maintaining a space between the core sample and the sponge material.

As used herein, the phrase "surface height variance" means and includes the degree to which a surface varies from an average height of the surface. For example, surface height variance may be expressed in terms of the maximum distance the surface deviates from the average height of the surface.

As used herein, the term "eccentricity" means and includes the degree to which the centers of two substantially concentric circles are offset from one another. For example, eccentricity may be expressed in terms of the distance between the centers of two substantially concentric circles.

Figure 1:
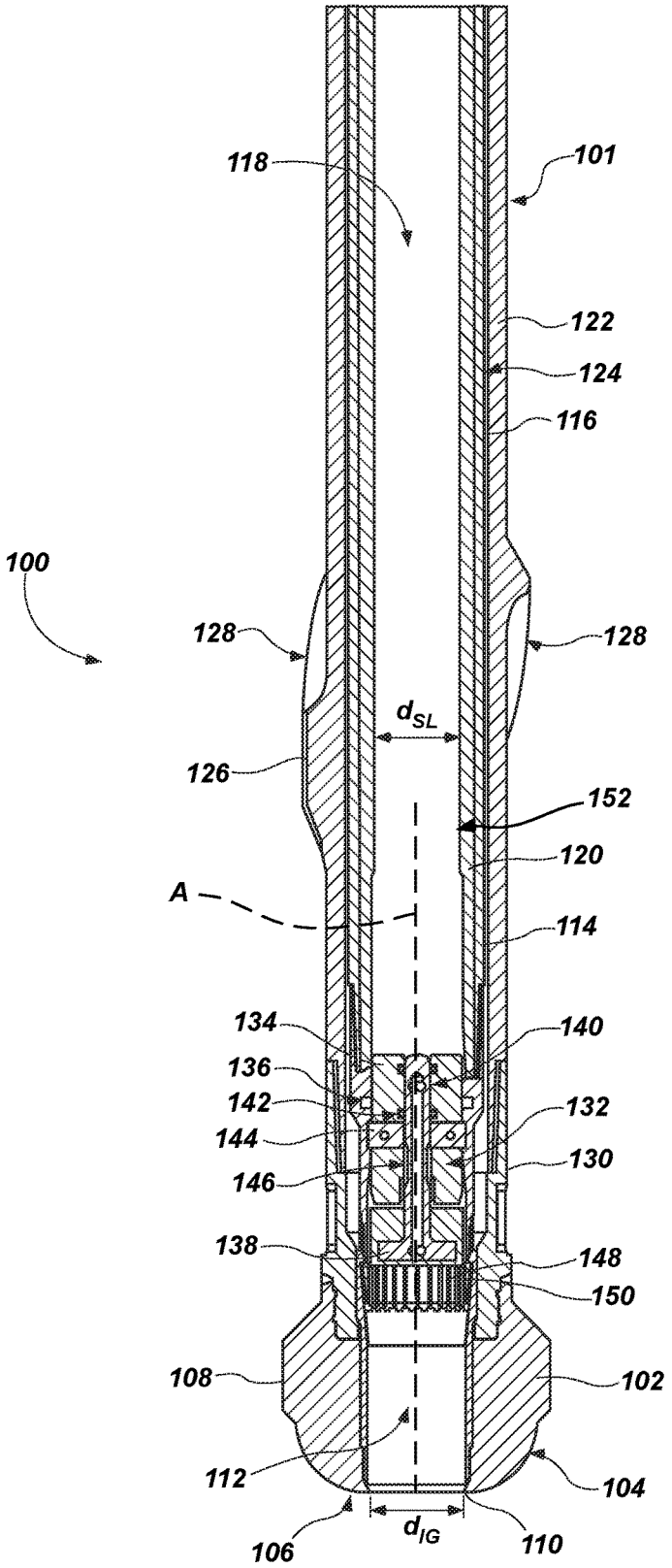
FIG. 1 is a cross-sectional view of a coring tool.

Referring to FIG. 1, a cross-sectional view of a coring tool 100 is shown. The coring tool 100 may include a coring bit 102 configured to be positioned at the bottom of a drill string 101. The coring bit 102 may include a cutting structure 104 distributed over a face 106 of the coring bit 102. The cutting structure 104 may be configured to cut into and remove material from an underlying earth formation. The cutting structure 104 may include, for example, an outer gage 108 at a radially outermost position on the coring bit 102. The cutting structure 104 may further include an inner gage 110 located radially inward from the outer gage 108. The inner gage 110 may define a maximum diameter of a core sample 154 (see FIG. 4) to be cut using the coring bit 102. The inner gage 110 may be located at a lowermost periphery of an inner bore 112 extending through the coring bit 102. Thus, the cutting structure 104 may surround the inner bore 112. The inner bore 112 may be configured to receive a core sample 154 (see FIG. 4) as the cutting structure 104 removes material surrounding the core sample 154 (see FIG. 4), such that the core sample 154 (see FIG. 4) extends through the coring bit 102 as the coring bit 102 advances into the earth formation. The coring bit 102 may be formed from a material suitable for use in a downhole environment, such as, for example, cemented tungsten carbide or steel.

The coring tool 100 may further include a receptacle 114 configured to receive a core sample 154 (see FIG. 4) at least partially within the receptacle 114. The receptacle 114 may be connected to the coring bit 102. For example, the receptacle 114 may be located partially within the inner bore 112 with a lower end of the receptacle 114 being located adjacent to the inner gage 110 of the cutting structure 104. As another example, the receptacle 114 may be located longitudinally above the coring bit 102. The receptacle 114 may be rotatable with respect to the coring bit 102, such that the receptacle 114 may remain rotationally stationary as it receives a coring sample while the coring bit 102 rotates to cut the coring sample. For example, the receptacle 114 may be connected to the coring bit 102 by a bearing supporting the receptacle 114 within the inner bore 112. The receptacle 114 may be generally tube-shaped and may include an inner surface 116 defining a bore 118 extending at least partially through the receptacle 114. The bore 118 may be sized and configured to receive a core sample 154 (see FIG. 4) formed using the coring bit 102 longitudinally (i.e., in a direction parallel to a direction in which the coring tool 100 is advanced when procuring a core sample 154 (see FIG. 4)) within the bore 118. The receptacle 114, and particularly the bore 118 extending through the receptacle 114, may extend for at least as long as a desired longitudinal length of a core sample 154 (see FIG. 4) to be analyzed. In some embodiments, the receptacle 114 may be rotatable with respect to the drill string 101 such that rotation of the drill string 101 does not necessarily produce corresponding rotation of the receptacle 114. The receptacle 114 may be formed from a material suitable for use in a downhole environment, such as, for example, aluminum.

Figure 4:
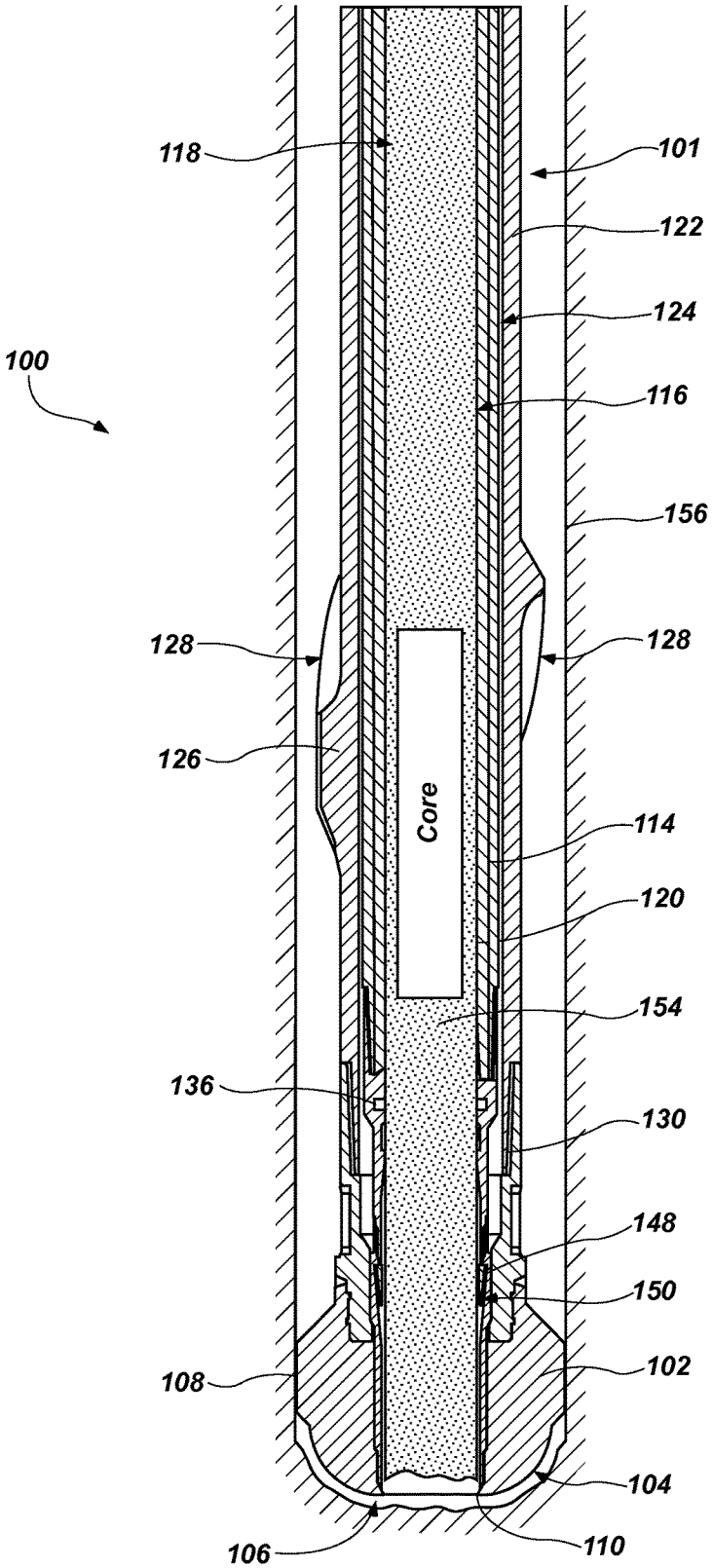
FIG. 4 is a cross-sectional view of the coring tool of FIG. 1 after procuring a core sample.

The coring tool 100 may also include a sponge material 120 configured to absorb a liquid expected to be found within a core sample 154 (see FIG. 4). The sponge material 120 may be positioned to be radially adjacent to a core sample 154 (see FIG. 4) within the receptacle 114 as the coring tool 100 is extracted from a borehole 156 (see FIG. 4). For example, the sponge material 120 may line (e.g., be adhered to) the inner surface 116 of the receptacle 114 or may be positioned within the receptacle 114 adjacent to the inner surface 116, which may or may not involve affixing the sponge material 120 to the inner surface 116. The sponge material 120 may define a diameter of the bore 118 into which the core sample 154 (see FIG. 4) may be received. The sponge material 120 may comprise, for example, a porous body characterized by an open network of pores into which fluid may infiltrate. A material of the sponge material 120 may comprise, for example, a foam (e.g., a polyurethane foam), coat, a felt, or any other material into which fluids may infiltrate (e.g., using capillary action to draw the fluid into the material), which may be preferentially wetted by oil. In embodiments where the sponge material 120 exhibits preferential wettability (i.e., more easily absorbs a selected fluid), the sampling of fluids within the sponge material 120 after procuring a core sample may not reflect the concentration of all fluids escaped from the core sample, but may more accurately reflect the concentration of a particular fluid of interest (e.g., oil). The sponge material 120 may be provided, for example, in sections that are individually inserted into the receptacle 114 and attached to the inner surface 116 of the receptacle adjacent to one another until they line an entire longitudinal length of the receptacle 114 above a selected point.

The coring tool 100 may include an outer barrel 122 connected to the coring bit 102. The outer barrel 122 may comprise, for example, a generally tubular member, the lower end of which may be attached to the coring bit 102. The outer barrel 122 may be connected to the remainder of the drill string 101 and may transfer loads (e.g., weight-on-bit and torque) to the coring bit 102 to drive the coring bit 102 into an underlying earth formation. The receptacle 114 may be located within the outer barrel 122, and a flow path 124 may be defined between the receptacle 114 and the outer barrel 122 to enable drilling fluid to be pumped to the coring bit 102 (e.g., to nozzles on the coring bit 102 or simply out the inner bore 112 proximate the inner gage 110), which may serve to remove cuttings produced while coring. The flow path 124 may be isolated from the bore 118 of the receptacle 114 such that the bore 118, and the sponge material 120 within the bore 118, is not contaminated with material from the drilling fluid before an activation piston 132 is released and the bore 118 is depressed.

The outer barrel 122 may include a stabilizer 126 configured to stabilize the coring bit 102 as it is driven into an underlying earth formation in some embodiments. In other embodiments, one or more stabilizers may be connected to the coring tool 100 (e.g., instead of, or in addition to, the stabilizer 126 incorporated into the coring tool 100 itself). The stabilizer 126 may include blades 128 extending radially outward from a remainder of the outer barrel 122. The blades 128 may contact and ride against walls of a borehole to stabilize the coring bit 102 as it is advanced (e.g., driven linearly or driven linearly and rotationally). The blades 128 may be fixed in position in some embodiments. In other embodiments, the blades 128 may be extendable to a radially outermost position in which they contact and ride against the borehole wall and retractable to a radially innermost position in which they do not contact the borehole wall. The stabilizer 126 may be located longitudinally adjacent to the coring bit 102 (i.e., there may not be any radially protruding features on the coring tool 100 between the coring bit 102 and the stabilizer 126). For example, the outer barrel 122 may be the first section of the drill string 101 attached to the coring bit 102. In some embodiments, a shank 130 may be used to attach the coring bit 102 to the outer barrel 122. In other embodiments, the coring bit 102 may be directly attached to the outer barrel 122. In each configuration, the stabilizer 126 may be said to be longitudinally adjacent to the coring bit 102. Thus, there may not be any additional drill string sections (e.g., subs) between the outer barrel 122 on which the stabilizer 126 is located and the coring bit 102.

The coring tool 100 may include an activation piston 132 configured to seal off the bore 118 of the receptacle 114 until a core sample 154 (see FIG. 4) is introduced into the bore 118. The activation piston 132 may include, for example, a piston body 134 located within the bore 118 of the receptacle 114. A seal 136 may be formed between the inner surface 116 of the receptacle 114 and the piston body 134, for example, by positioning an O-ring configured to contact the piston body 134 within a recess formed in the inner surface 116 of the receptacle 114. The seal 136 may further be configured to wipe contaminants, such as, for example, drilling fluid, off a core sample 154 (see FIG. 4) as it advances into the receptacle 114. The activation piston 132 may further include an activation rod 138 configured to release the activation piston 132 and unseal the bore 118 when depressed. The activation piston 132 may be partially located within and may be movable longitudinally with respect to a bore 140 extending through the piston body 134. A seal 142 may be formed between the activation rod 138 and the piston body 134, for example, by positioning an O-ring configured to contact the activation rod 138 within a recess formed in a surface defining the bore 140 of the piston body 134. The seals 136 and 142 may cooperatively seal the interior of the bore 118 from the inner bore 112, reducing (e.g., eliminating) the likelihood that contaminants, such as, for example, drilling fluid and abrasives suspended within the drilling fluid, will enter the bore 118 as the coring tool 100 travels into a wellbore.

The activation piston 132 may be secured in place within the receptacle 114 by locking dogs 144. When the activation rod 138 is not depressed, the locking dogs 144 may press against the activation rod 138 and the inner surface 116 of the receptacle 114 such that mechanical interference between the activation rod 138, locking dogs 144, and inner surface 116 of the receptacle 114 holds the activation piston 132 in place. When the activation rod 138 is depressed, for example, by a core sample 154 (see FIG. 4) advancing through the inner bore 112 of the coring bit 102 into the bore 118 of the receptacle 114, a recess 146 extending around the activation rod 138 may align with the locking dogs 144. The locking dogs 144 may be free to move partially into the recess 146, reducing (e.g., releasing) their frictional engagement with the inner surface 116 of the receptacle. The activation piston 132 may then be free to move into the bore 118 as it rides on top of an advancing core sample 154 (see FIG. 4) being received into the receptacle 114.

The coring tool 100 may include a core catcher 148 configured to retain a core sample 154 (see FIG. 4) within the receptacle 114 while removing the coring tool 100 and core sample 154 (see FIG. 4) from a borehole. The core catcher 148 may comprise, for example, a wedging collet. A wedge-shaped outer surface 150 of the core catcher 148 may be sized and shaped to enable a core sample 154 (see FIG. 4) to pass through the core catcher 148 when traveling longitudinally upward into the receptacle. When the coring tool 100 begins to back out of the borehole, the wedge-shaped outer surface 150 may engage with a surface defining the inner bore 112, causing the core catcher 148 to constrict around and frictionally engage with a core sample 154 (see FIG. 4), reducing (e.g., eliminating) the likelihood that the core sample 154 (see FIG. 4) will exit the receptacle 114 after it has entered the bore 118.

When a core sample 154 (see FIG. 4) is located within the receptacle 114, the core sample 154 (see FIG. 4) may be spaced from the sponge material 120 lining the inner surface 116 of the receptacle 114. As the coring tool 100 is removed from a wellbore, fluids may escape from within the core sample 154 (see FIG. 4) due to, for example, changes in temperature and pressure (e.g., reducing hydrostatic pressure as depth from the surface decreases). Escaped fluids may enter the gap between the core sample 154 (see FIG. 4) and the sponge material 120, and the sponge material is intended to absorb the escaped fluids. If the core sample 154 (see FIG. 4) is too distant from the sponge material 120, however, the escaped fluids may be free to flow along the longitudinal length of the receptacle 114. The escaped fluids may eventually be absorbed by the sponge material 120 at a longitudinal position different from (e.g., higher or lower than) the longitudinal position at which the fluids escaped. In such a situation, a large gap may reduce (e.g., eliminate) the likelihood that measurements of local concentrations of the fluid accurately reflect the actual local concentrations of the fluid in the earth formation from which the core sample 154 (see FIG. 4) was procured. Some of the escaped fluids may even escape the bore 118 altogether, despite the seal 136, and be lost into drilling fluid circulating in the inner bore 112 and the borehole. Accordingly, a large gap may reduce (e.g., eliminate) the likelihood that measurements of total concentrations of the fluid accurately reflect the actual total concentration of the fluid in the earth formation from which the core sample 154 (see FIG. 4) was procured.

If the gap between the core sample 154 (see FIG. 4) and the sponge material 120 is eliminated, however, further difficulties may be encountered. For example, interference between the sponge material 120 and the core sample 154 (see FIG. 4) may increase the force (e.g., weight-on-bit) required to drive the coring tool 100 into the earth formation. If the force required to advance the coring tool 100 into the earth formation exceeds the strength (e.g., the compressive yield strength) of the earth formation, continued application of force may simply crush the underlying earth formation as the coring bit 102 and the trailing end of the core sample 154 (see FIG. 4) grind against it (e.g., the core sample 154 (see FIG. 4) may become jammed partway through the receptacle 114, rendering the production of a complete core sample 154 difficult, if not impossible). Therefore, providing interference between the sponge material 120 and the core sample 154 (see FIG. 4) may reduce (e.g., eliminate) the likelihood that a complete core sample 154 (see FIG. 4) as long as the entire longitudinal length of the receptacle 114 may be obtained. If the force required to advance the coring tool 100 into the earth formation exceeds the attachment strength (e.g., the shear strength of an adhesive) of the sponge material 120 to the inner surface 116 of the receptacle 114, the advancing core sample 154 (see FIG. 4) may cause the sponge material 120 to detach from the receptacle 114. In this way, eliminating the space between the sponge material 120 and the core sample 154 (see FIG. 4) may reduce (e.g., eliminate) the likelihood that sponge material 120 will be present to absorb all fluid escaping from the core sample 154 (see FIG. 4) at or near the same longitudinal location at which the fluid escapes, which may reduce the confidence that measurements from the core sample 154 (see FIG. 4) accurately reflect characteristics of the earth formation.

By maintaining a space between the sponge material 120 and the core sample 154 (see FIG. 4), but reducing the size of the space, the likelihood that a complete core sample 154 (see FIG. 4) will be obtained and that measurements from the core sample 154 (see FIG. 4), including measurements from escaped fluids absorbed by the sponge material 120, will accurately reflect both local and total characteristics of the earth formation at the bottom of the wellbore may be increased. The space may be maintained, but reduced in size, by, for example, reducing the radial distance between the inner gage 110 and the sponge material 120, reducing wobbling of the coring tool 100 while procuring a core sample 154 (see FIG. 4), and reducing manufacturing variations on the inner gage 110, outer gage 108, inner surface 116 of the receptacle 114, and sponge material 120. The reduced distance between the sponge material 120 and the core sample 154 (see FIG. 4) may be, for example, about 1 mm or less. More specifically, the reduced distance between the sponge material 120 and the core sample 154 (see FIG. 4) may be, for example, between about 0.01 mm and about 0.6 mm. As a specific, nonlimiting example, the reduced distance between the sponge material 120 and the core sample 154 (see FIG. 4) may be between about 0.01 mm and about 0.3 mm (e.g., about 0.15 mm).

A difference between a diameter $d_{SL}$ of the bore 118 defined by an inner surface 152 of the sponge material 120 and a diameter $d_{IG}$ defined by the inner gage 110 may be reduced, although some difference may be maintained, to enable maintenance of a smaller space between a core sample 154 (see FIG. 4) cut by the inner gage 110 and the sponge material 120. For example, a distance (e.g., a maximum distance) between a projection of the inner surface 152 of the sponge material 120 and the inner gage 110 on a plane P extending perpendicular to an axis of rotation A (see FIG. 1) of the coring tool 100 may be between about 0.01 mm and about 2 mm when the inner surface 152 of the sponge material 120 and the inner gage 110 are at least substantially concentric and parallel to one another. More specifically, the distance between the projection of the inner surface 152 of the sponge material 120 and the inner gage 110 on the plane P extending perpendicular to the axis of rotation A of the coring tool 100 may be, for example, between about 0.2 mm and about 1.5 mm. As a specific, nonlimiting example, the distance between the projection of the inner surface 152 of the sponge material 120 and the inner gage 110 on the plane P extending perpendicular to the axis of rotation A of the coring tool 100 may be between about 0.5 mm and about 1 mm (e.g., about 0.75 mm). As another example, a radial distance between the inner surface 152 of the sponge material 120 and the inner gage 110 may be about 1 mm or less along at least 75% of a longitudinal length of the sponge material 120. More specifically, the radial distance between the inner surface 152 of the sponge material 120 and the inner gage 110 may be, for example, about 0.5 mm or less along at least 75% of the longitudinal length of the sponge material 120. As a specific, nonlimiting example, the radial distance between the inner surface 152 of the sponge material 120 and the inner gage 110 may be, for example, about 0.5 mm or less along at least 90% of the longitudinal length of the sponge material 120.

Figure 2:
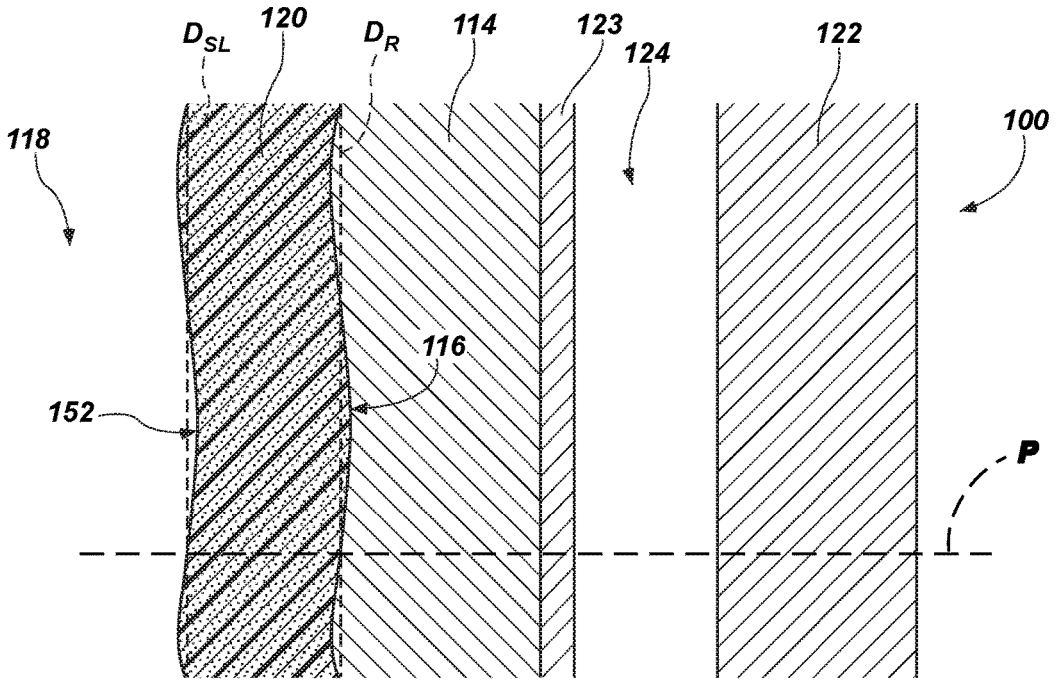
FIG. 2 is a simplified cross-sectional view of a portion of the coring tool of FIG. 1.

Referring to FIG. 2, a simplified cross-sectional view of a portion of the coring tool 100 of FIG. 1 is shown. In some embodiments, such as the embodiment shown in FIG. 2, the sponge material 120 and receptacle 114 (sometimes collectively referred to as a "sponge liner") may be received within (e.g., adhered to the inner surface of or simply inserted within without being affixed to) an inner tube 123 located within the outer barrel 122. The flow path 124 for drilling fluid may be defined between the inner tube 123 and the outer barrel 122.

A surface height variance of an inner surface 152 of the sponge material 120 may be reduced to maintain, but reduce the size of, a gap between the sponge material 120 and core sample 154 (see FIG. 4) by creating a more consistent surface from which to define a gap. For example, a maximum distance the inner surface 152 of the sponge material 120 deviates from an average radial distance $D_g$ from an axial center of the sponge material 120 along a longitudinal length of the sponge material may be about 0.2 mm or less along at least 75% of the longitudinal length of the sponge material 120. More specifically, the surface height variance of the inner surface 152 of the sponge material 120 may be, for example, about 0.2 mm or less along at least 90% of the longitudinal length of the sponge material 120. As a specific, nonlimiting example, the surface height variance of the inner surface 152 of the sponge material 120 may be about 0.1 mm or less. As another example, the surface height variance of the inner surface 152 of the sponge material 120 may be between about 0.025 mm and about 0.175 mm. More specifically, the surface height variance of the inner surface 116 of the receptacle 114 may be between about 0.05 mm and about 0.15 mm (e.g., about 0.1 mm). In other words, a maximum deviation of the inner surface 152 of the sponge material 120 from an average diameter of the sponge material 120 may be, for example, about 0.2 mm or less along at least 75% of the longitudinal length of the sponge material 120. More specifically, the maximum deviation of the inner surface 152 of the sponge material 120 from the average diameter of the sponge material 120 may be, for example, about 0.2 mm or less along at least 90% of the longitudinal length of the sponge material 120. The surface height variance of the inner surface 152 of the sponge material 120 may be reduced by, for example, imposing tighter tolerance requirements on the manufacturing processes used to define the inner surface 152 of the sponge material 120. For example, the tolerances imposed may be about 10 times as precise as those imposed on conventional coring tools.

Figure 3:
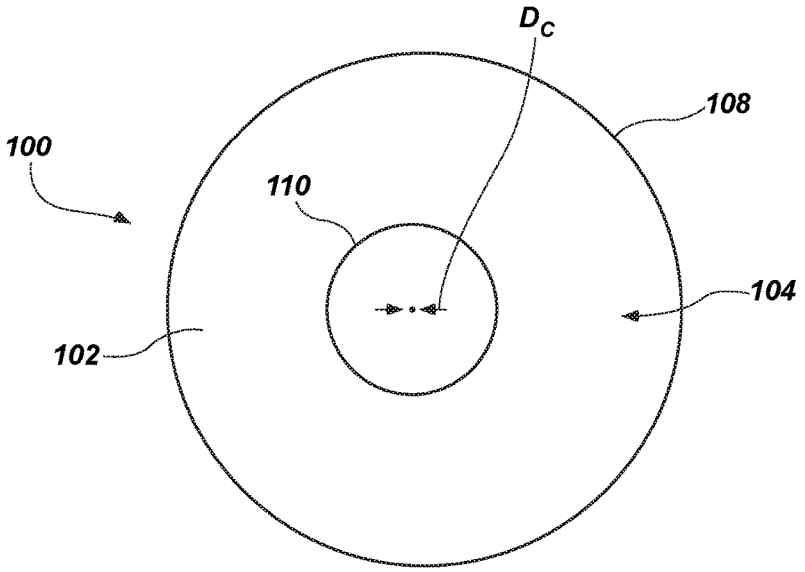
FIG. 3 is a simplified end view of the coring tool of FIG. 1 from the perspective of the bottom of a borehole.

Referring to FIG. 3, a simplified end view of the coring tool 100 of FIG. 1 from the perspective of the bottom of a borehole 156 (see FIG. 4) is shown. An eccentricity of the inner gage 110 with respect to the outer gage 108 may be reduced to maintain, but reduce the size of, a gap between the sponge material 120 and core sample 154 (see FIG. 4) by reducing the occurrence of wobbling of the coring tool 100 while advancing into an earth formation. For example, a distance $D_C$ between centers of curvature of the inner gage 110 and the outer gage 108 of the coring bit 102 may be about 0.3 mm or less (e.g., when the inner gage 110 and the outer gage 108 are circles, the centers of curvature may be located at the centerpoint of each circle). More specifically, the eccentricity of the outer gage 108 of the coring bit 102 with respect to the inner gage 110 of the coring bit 102 may be, for example, about 0.2 mm or less. As a specific, nonlimiting example, the eccentricity of the outer gage 108 with respect to the inner gage 110 may be about 0.1 mm or less (e.g., about 0.05 mm). The eccentricity of the outer gage 108 with respect to the inner gage 110 may be reduced by, for example, forming the outer gage 108 and the inner gage 110 using the same machinery (e.g., lathe) without removing the coring bit 102 from the machinery, which may cause the coring bit 102 to rotate about the same axis of rotation when forming the inner gage 110 and the outer gage 108, and by imposing tighter tolerance requirements on the manufacturing processes. For example, the tolerances imposed may be about 10 times as precise as those imposed on conventional coring tools.

Referring to FIG. 4, a cross-sectional view of the coring tool 100 of FIG. 1 is shown after procuring a core sample 154. To procure the core sample 154, the coring tool 100 may be lowered to the bottom of a borehole 156. The coring tool 100 may then be advanced into the underlying earth formation (e.g., by applying weight-on-bit and rotating the drill string 101) to cut the core sample 154 and insert the core sample 154 into the inner bore 112 of the coring bit 102. As the coring tool 100 continues to advance, the core sample 154 may contact the activation rod 138 (see FIG. 1) of the activation piston 132 (see FIG. 1), unseal the bore 118 of the receptacle 114, and enter the bore 118 of the receptacle 114. Once a desired length of core sample 154 has entered the bore 118, the coring tool 100 may be backed out of the borehole 156. The core catcher 148 may engage with the core sample 154, and may secure the core sample 154 within the coring tool 100 as the coring tool 100 is removed from the borehole 156.

Figure 5:
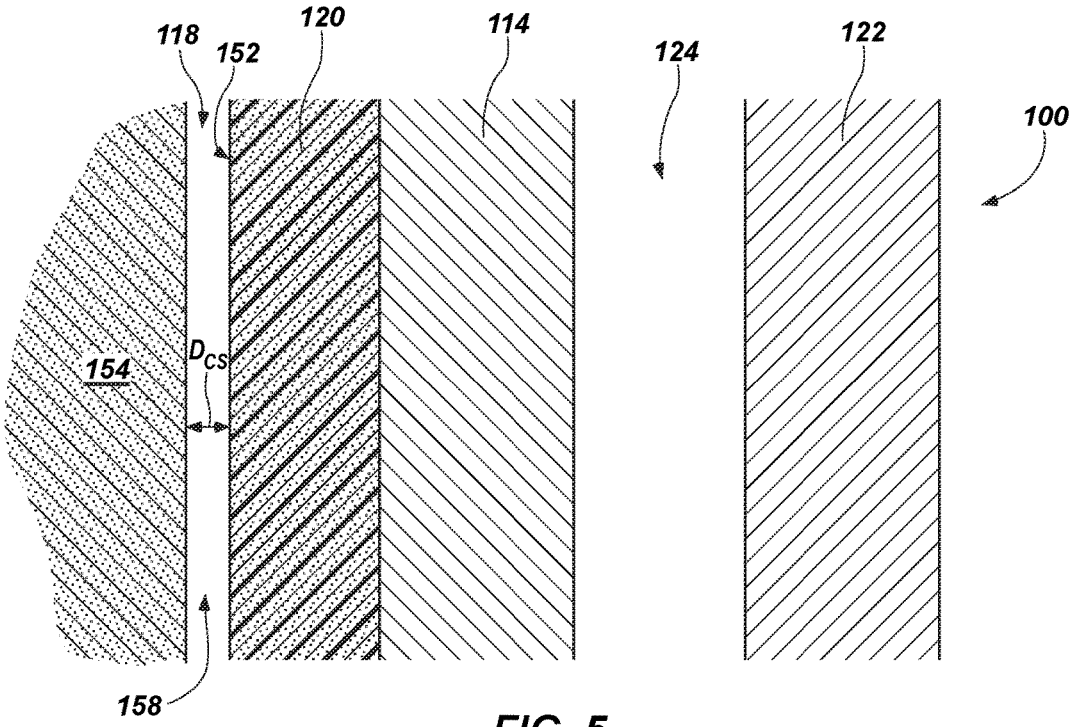
FIG. 5 is a simplified cross-sectional view of a portion of the coring tool of FIG. 4.

Referring to FIG. 5, a simplified cross-sectional view of a portion of the coring tool 100 of FIG. 4 is shown. As the core sample 154 is received into the bore 118 of the receptacle 114, and while the core sample 154 is retained in the bore 118 of the receptacle 114 by the core catcher 148 (see FIG. 4), a space 158 may be maintained between the core sample 154 and the sponge material 120. For example, a maximum distance $D_{CS}$ between the core sample 154 and the sponge material 120 may be about 1 mm or less. More specifically, the distance $D_{CS}$ between the core sample 154 and the sponge material 120 may be, for example, between about 0.01 mm and about 0.6 mm. As a specific, nonlimiting example, the distance $D_{CS}$ between the core sample 154 and the sponge material 120 may be between about 0.01 mm and about 0.3 mm. By maintaining, but reducing the size of, the space 158 between the core sample 154 and the sponge material 120, the measurements of fluids from the core sample may more accurately reflect the local and total concentrations of the fluids in the earth formation at the bottom of the borehole 156 and the likelihood that a complete core sample 154 will be procured may be increased.

Figure 6:
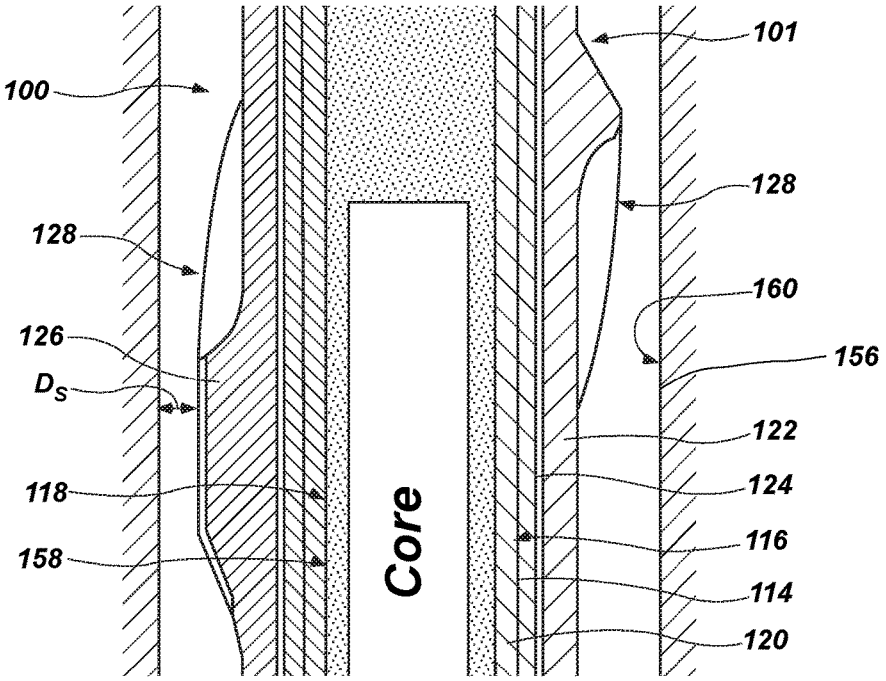
FIG. 6 is a cross-sectional view of a stabilizer of the coring tool of FIG. 4.

Referring to FIG. 6, a cross-sectional view of a stabilizer 126 of the coring tool 100 of FIG. 4 is shown. The stabilizer 126 may be located longitudinally adjacent to the coring bit 102 (see FIG. 4) and may reduce wobbling of the coring bit 102. For example, the blades 128 of the stabilizer 126 may contact and ride against the wall 160 of the borehole 156 as the drill string 101 is rotated, which may reduce the extent to which the drill string 101, and particularly the coring bit 102 at the end of the drill string 101, wobbles within the borehole 156. The blades 128 may extend radially outward to a location closer to the wall 160 of the borehole 156 to further reduce wobbling, which may maintain, but reduce the size of, the space 158 between the core sample 154 and the sponge material 120 as the core sample 154 is formed and inserted into the receptacle 114. For example, a radial distance $D_S$ (i.e., a distance measured radially outward from an axis of rotation of the stabilizer 126) between the blades 128 of the stabilizer 126 and the outer gage 108 (see FIG. 1; represented in FIG. 6 as being equal to the wall 160 of the borehole 156; see also FIG. 1) may be about 1 mm or less. More specifically, the radial distance $D_S$ between the blades 128 of the stabilizer 126 and the outer gage 108 (see FIG. 1) may be, for example, about 0.9 mm or less. As a specific, nonlimiting example, the radial distance $D_S$ between the blades 128 of the stabilizer 126 and the outer gage 108 (see FIG. 1) may be about 0.75 mm or less (e.g., about 0.5 mm). The radial distance $D_S$ between the blades 128 of the stabilizer 126 and the outer gage 108 (see FIG. 1) may be reduced by, for example, selecting a stabilizer 126 exhibiting a nominal diameter closer to the diameter of the outer gage 108 (and the nominal diameter of the borehole 156, see FIG. 1). For example, an outer diameter of the stabilizer 126 may be about 1 mm or less greater than an outer diameter of the outer gage 108 (see FIG. 1) when outer surfaces of the stabilizer 126 and the outer gage 108 (see FIG. 1) are at least substantially concentric and parallel to one another. More specifically, the outer diameter of the stabilizer 126 may be, for example, between about 0.2 mm and about 0.6 mm greater than the outer diameter of the outer gage 108 (see FIG. 1). As a specific, nonlimiting example, the outer diameter of the stabilizer 126 may be, for example, between about 0.3 mm and about 0.5 mm greater than the outer diameter of the outer gage 108 (see FIG. 1).

Additional, nonlimiting embodiments within the scope of this disclosure include:

Embodiment 1

A coring tool, comprising: a coring bit comprising an inner gage and an outer gage; and a sponge material positioned to at least partially surround a core sample cut by the coring bit; wherein a radial distance between an inner surface of the sponge material and the inner gage of the coring bit is about 1 mm or less along at least 75% of a longitudinal length of the sponge material; and wherein a distance between a center of curvature of the inner gage and a center of curvature of the outer gage is about 0.3 mm or less.

Embodiment 2

The coring tool of Embodiment 1, wherein the distance between the center of curvature of the inner gage and the center of curvature of the outer gage is about 0.2 mm or less.

Embodiment 3

The coring tool of Embodiment 2, wherein the distance between the center of curvature of the inner gage and the center of curvature of the outer gage is about 0.1 mm or less.

Embodiment 4

The coring tool of any one of Embodiments 1 through 3, wherein the radial distance between the inner surface of the sponge material and the inner gage of the coring bit is about 0.5 mm or less along at least 75% of the longitudinal length of the sponge material.

Embodiment 5

The coring tool of Embodiment 4, wherein the radial distance between the inner surface of the sponge material and the inner gage of the coring bit is about 0.5 mm or less along at least 90% of the longitudinal length of the sponge material.

Embodiment 6

The coring tool of any one of Embodiments 1 through 5, further comprising a stabilizer connected to the coring bit, an outer diameter of the stabilizer being between about 0.2 mm and about 0.6 mm greater than an outer diameter of the outer gage.

Embodiment 7

The coring tool of any one of Embodiments 1 through 6, wherein a maximum deviation of the inner surface of the sponge material from an average diameter of the sponge material is about 0.2 mm or less along at least 75% of the longitudinal length of the sponge material.

Embodiment 8

The coring tool of Embodiment 7, wherein the maximum deviation of the inner surface of the sponge material from the average diameter of the sponge material is about 0.2 mm or less along at least 90% of the longitudinal length of the sponge material.

Embodiment 9

A method of making a coring tool, comprising: rotating a body of a coring bit about an axis of rotation while forming an inner gage in the body; and rotating the body about the same axis of rotation while forming an outer gage on the body.

Embodiment 10

The method of Embodiment 9, further comprising connecting the coring bit to a sponge material positioned to at least partially surround a core sample cut by the coring bit, wherein a radial distance between an inner surface of the sponge material and the inner gage of the coring bit is about 1 mm or less along at least 75% of a longitudinal length of the sponge material.

Embodiment 11

A coring tool, comprising: a coring bit comprising a cutting structure surrounding an inner bore, the cutting structure comprising an outer gage at a radially outermost position on the coring bit and an inner gage at a periphery of the inner bore, the inner gage being configured to cut a core sample to be received into the inner bore; a receptacle connected to the coring bit, the receptacle comprising an inner surface defining a bore configured to receive a core sample within the bore; and a sponge material attached to the inner surface of the receptacle, the sponge material being configured to absorb a fluid expected to be found within the core sample; wherein a distance between a projection of an inner surface of the sponge material and the inner gage on a plane extending perpendicular to an axis of rotation of the coring tool is about 1 mm or less along at least 75% of a longitudinal length of the sponge material.

Embodiment 12

The coring tool of Embodiment 11, wherein the distance between the projection of the inner surface of the sponge material and the inner gage on the plane extending perpendicular to the axis of rotation of the coring tool is about 0.6 mm or less.

Embodiment 13

The coring tool of Embodiment 12, wherein the distance between the projection of the inner surface of the sponge material and the inner gage on the plane extending perpendicular to the axis of rotation of the coring tool is about 0.3 mm or less.

Embodiment 14

The coring tool of any one of Embodiments 11 through 13, wherein an eccentricity of the outer gage of the coring bit with respect to the inner gage of the coring bit is about 0.3 mm or less.

Embodiment 15

The coring tool of any one of Embodiments 1 through 14, wherein a surface height variance of the inner surface of the sponge material along at least 75% of the longitudinal length of the sponge material is about 0.2 mm or less.

Embodiment 16

The coring tool of Embodiment 15, wherein the surface height variance of an inner surface of the sponge material along the longitudinal length of the sponge material is about 0.2 mm or less along at least 90% of the longitudinal length of the sponge material.

Embodiment 17

The coring tool of any one of Embodiments 1 through 13, further comprising a stabilizer connected to the coring bit, a radial distance between blades of the stabilizer and the outer gage being between about 0.2 mm and about 0.6 mm.

Embodiment 18

A method of making a coring tool, comprising: forming an inner gage and an outer gage on a coring bit comprising a cutting structure surrounding an inner bore, the outer gage being formed at a radially outermost position on the coring bit and the inner gage being formed at a periphery of the inner bore, the inner gage being configured to cut a core sample to be received into the inner bore; connecting a receptacle to the coring bit, the receptacle comprising an inner surface defining a bore configured to receive a core sample within the bore; and attaching a sponge material to the inner surface of the receptacle, the sponge material being configured to absorb a fluid expected to be found within the core sample; wherein forming the inner gage comprises forming a diameter of the inner gage to be smaller than a diameter defined by an inner surface of the sponge material by about 1 mm or less along at least 75% of a longitudinal length of the sponge material.

Embodiment 19

The method of Embodiment 18, wherein forming the diameter of the inner gage to be smaller than the diameter defined by the inner surface of the sponge material by about 1 mm or less comprises forming the diameter of the inner gage to be smaller than the diameter defined by the inner surface of the sponge material by about 0.6 mm or less.

Embodiment 20

The method of Embodiment 19, wherein forming the diameter of the inner gage to be smaller than the diameter defined by the inner surface of the sponge material by about 0.6 mm or less comprises forming the diameter of the inner gage to be smaller than the diameter defined by the inner surface of the sponge material by about 0.3 mm or less.

Embodiment 21

The method of any one of Embodiments 18 through 20, further comprising forming an eccentricity of the outer gage of the coring bit with respect to the inner gage of the coring bit to be about 0.3 mm or less.

Embodiment 22

The method of any one of Embodiments 18 through 21, further comprising forming a surface height variance of the inner surface of the sponge material along at least 75% of the longitudinal length of the sponge material to be about 0.2 mm or less.

Embodiment 23

The method of Embodiment 22, further comprising forming the surface height variance of an inner surface of the sponge material along the longitudinal length of the sponge material to be about 0.2 mm or less along at least 90% of the longitudinal length of the sponge material.

Embodiment 24

The method of any one of Embodiments 18 through 23, further comprising connecting a stabilizer to the coring bit, a radial distance between blades of the stabilizer and the outer gage being between about 0.2 mm and about 0.6 mm.

Embodiment 25

A method of procuring a core sample using a coring tool, comprising: engaging an earth formation with a cutting structure of a coring bit; receiving a core sample within a bore of a receptacle connected to the coring bit, the receptacle being lined with a sponge material; and maintaining a space of about 1 mm or less between the core sample and the sponge material.

Embodiment 26

The method of Embodiment 25, wherein maintaining the space of about 1 mm or less between the core sample and the sponge material comprises maintaining a space of about 0.6 mm or less between the core sample and the sponge material.

Embodiment 27

The method of Embodiment 26, wherein maintaining the space of about 0.6 mm or less between the core sample and the sponge material comprises maintaining a space of about 0.3 mm or less between the core sample and the sponge material.

Embodiment 28

The method of any one of Embodiments 25 through 27, wherein maintaining the space of about 1 mm or less between the core sample and the sponge material comprises stabilizing the coring bit and receptacle using a stabilizer connected to the coring bit, a radial distance between blades of the stabilizer and an outer gage of the coring bit being between about 0.2 mm and about 0.6 mm.

Embodiment 29

A coring tool, comprising: a coring bit comprising a cutting structure surrounding an inner bore, the cutting structure comprising an outer gage at a radially outermost position on the coring bit and an inner gage at a periphery of the inner bore, the inner gage being configured to cut a core sample to be received into the inner bore; a receptacle connected to the coring bit, the receptacle comprising an inner surface defining a bore configured to receive a core sample within the bore; a sponge material attached to the inner surface of the receptacle, the sponge material being configured to absorb a fluid expected to be found within the core sample; and a core sample located within the bore, the core sample being spaced from the sponge material along a longitudinal length of a sponge liner by 1 mm or less.

Embodiment 30

The coring tool of Embodiment 27, wherein the core sample is spaced from the inner surface of the sponge material along the longitudinal length of the sponge liner by 0.6 mm or less.

Embodiment 31

The coring tool of Embodiment 28, wherein the core sample is spaced from the inner surface of the sponge material along the longitudinal length of the sponge liner by 0.3 mm or less.

Embodiment 32

The coring tool of any one of Embodiments 27 through 30, wherein an eccentricity of the outer gage of the coring bit with respect to the inner gage of the coring bit is 0.3 mm or less.

Embodiment 33

The coring tool of any one of Embodiments 27 through 31, wherein a surface height variance of the inner surface of the sponge material along at least 75% of the longitudinal length of the sponge material is 0.2 mm or less.

Embodiment 34

The coring tool of any one of Embodiments 29 through 33, further comprising a stabilizer connected to the coring bit, a distance between blades of the stabilizer and a wall of a borehole from which the core sample was procured being between about 0.2 mm and about 0.6 mm.

Embodiment 35

The coring tool of Embodiment 34, wherein the stabilizer is located on a section of a drill string to which the coring bit is attached, the section being adjacent to the coring bit.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

The invention claimed is:

1. A coring tool, comprising:

a coring bit comprising an inner gage and an outer gage; and a sponge material positioned to at least partially surround a core sample cut by the coring bit;

wherein a radial distance between an inner surface of the sponge material and the inner gage of the coring bit is between about 0.01 mm and about 1 mm along at least 75% of a longitudinal length of the sponge material; and wherein a distance between a center of curvature of the inner gage and a center of curvature of the outer gage is about 0.3 mm or less.

2. The coring tool of claim 1, wherein the distance between the center of curvature of the inner gage and the center of curvature of the outer gage is about 0.2 mm or less.

3. The coring tool of claim 2, wherein the distance between the center of curvature of the inner gage and the center of curvature of the outer gage is about 0.1 mm or less.

4. The coring tool of claim 1, wherein the radial distance between the inner surface of the sponge material and the inner gage of the coring bit is between about 0.01 mm and about 0.5 mm along at least 75% of the longitudinal length of the sponge material.

5. The coring tool of claim 4, wherein the radial distance between the inner surface of the sponge material and the inner gage of the coring bit is between about 0.01 mm and about 0.5 mm along at least 90% of the longitudinal length of the sponge material.

6. The coring tool of claim 1, further comprising a stabilizer connected to the coring bit, an outer diameter of the stabilizer being between about 0.2 mm and about 0.6 mm greater than an outer diameter of the outer gage.

7. The coring tool of claim 1, wherein a maximum deviation of the inner surface of the sponge material from an average diameter of the sponge material is about 0.2 mm or less along at least 75% of the longitudinal length of the sponge material.

8. The coring tool of claim 7, wherein the maximum deviation of the inner surface of the sponge material from the average diameter of the sponge material is about 0.2 mm or less along at least 90% of the longitudinal length of the sponge material.

9. A method of making a coring tool, comprising:

rotating a body of a coring bit about an axis of rotation while forming an inner gage in the body;

rotating the body about the same axis of rotation while forming an outer gage on the body; and connecting the coring bit to a sponge material positioned to at least partially surround a core sample cut by the coring bit, wherein a radial distance between an inner surface of the sponge material and the inner gage of the coring bit is about 0.01 mm and about 1 mm along at least 75% of a longitudinal length of the sponge material.

10. The method of claim 9, wherein connecting the coring bit to the sponge material comprises rendering the radial distance between the inner surface of the sponge material and the inner gage of the coring bit between about 0.01 mm and about 0.5 mm along at least 90% of the longitudinal length of the sponge material.

11. A coring tool, comprising:

a coring bit comprising a cutting structure at least partially surrounding an inner bore, the cutting structure comprising an outer gage at a radially outermost position on the coring bit and an inner gage at a periphery of the inner bore, the inner gage being configured to cut a core sample to be received into the inner bore;

a receptacle connected to the coring bit, the receptacle comprising an inner surface defining a bore configured to receive a core sample within the bore; and a sponge material located within the receptacle, the sponge material being configured to absorb a fluid expected to be found within the core sample;

wherein a distance between a projection of an inner surface of the sponge material and the inner gage on a plane extending perpendicular to an axis of rotation of the coring tool is between about 0.01 mm and about 1 mm along at least 75% of a longitudinal length of the sponge material.

12. The coring tool of claim 11, wherein the distance between the projection of the inner surface of the sponge material and the inner gage on the plane extending perpendicular to the axis of rotation of the coring tool is between about 0.01 mm and about 0.6 mm.

13. The coring tool of claim 12, wherein the distance between the projection of the inner surface of the sponge material and the inner gage on the plane extending perpendicular to the axis of rotation of the coring tool is between about 0.01 mm and about 0.3 mm.

14. The coring tool of claim 11, wherein an eccentricity of the outer gage of the coring bit with respect to the inner gage of the coring bit is about 0.3 mm or less.

15. The coring tool of claim 11, wherein a surface height variance of the inner surface of the sponge material along at least 75% of the longitudinal length of the sponge material is about 0.2 mm or less.

16. The coring tool of claim 15, wherein the surface height variance of an inner surface of the sponge material along the longitudinal length of the sponge material is about 0.2 mm or less along at least 90% of the longitudinal length of the sponge material.

17. The coring tool of claim 11, further comprising a stabilizer connected to the coring bit, a radial distance between blades of the stabilizer and the outer gage being between about 0.2 mm and about 0.6 mm.

18. A method of making a coring tool, comprising:

forming an inner gage and an outer gage on a coring bit comprising a cutting structure surrounding an inner bore, the outer gage being formed at a radially outermost position on the coring bit and the inner gage being formed at a periphery of the inner bore, the inner gage being configured to cut a core sample to be received into the inner bore;

connecting a receptacle to the coring bit, the receptacle comprising an inner surface defining a bore configured to receive a core sample within the bore; and attaching a sponge material to the inner surface of the receptacle, the sponge material being configured to absorb a fluid expected to be found within the core sample;

wherein forming the inner gage comprises forming a diameter of the inner gage to be smaller than a diameter defined by an inner surface of the sponge material by between about 0.01 mm and about 1 mm along at least 75% of a longitudinal length of the sponge material.

19. The method of claim 18, wherein forming the diameter of the inner gage to be smaller than the diameter defined by the inner surface of the sponge material comprises forming the diameter of the inner gage to be smaller than the diameter defined by the inner surface of the sponge material by between about 0.01 mm and about 0.6 mm.

20. The method of claim 19, wherein forming the diameter of the inner gage to be smaller than the diameter defined by the inner surface of the sponge material comprises forming the diameter of the inner gage to be smaller than the diameter defined by the inner surface of the sponge material by between about 0.01 mm and about 0.3 mm.

21. The method of claim 18, further comprising forming an eccentricity of the outer gage of the coring bit with respect to the inner gage of the coring bit to be about 0.3 mm or less.

22. The method of claim 18, further comprising forming a surface height variance of the inner surface of the sponge material along at least 75% of the longitudinal length of the sponge material to be about 0.2 mm or less.

23. The method of claim 22, further comprising forming the surface height variance of an inner surface of the sponge material along the longitudinal length of the sponge material to be about 0.2 mm or less along at least 90% of the longitudinal length of the sponge material.

24. The method of claim 18, further comprising connecting a stabilizer to the coring bit, a radial distance between blades of the stabilizer and the outer gage being between about 0.2 mm and about 0.6 mm.

25. A method of procuring a core sample using a coring tool, comprising:

engaging an earth formation with a cutting structure of a coring bit;

receiving a core sample within a bore of a receptacle connected to the coring bit, the receptacle being lined with a sponge material; and maintaining a space of between about 0.01 mm and about 1 mm between the core sample and the sponge material.

* * * * *